US005997216A

United States Patent [19]

Kawashima

[11] Patent Number: 5,997,216

[45] Date of Patent: Dec. 7, 1999

[54] NEUTRAL BUOYANCY AUTO-BALANCER

[76] Inventor: Yoko Kawashima, 8-7, Sakurayama, 2-Chome, Zushi 249-0005, Japan

[21] Appl. No.: 09/184,411

[22] Filed: Nov. 2, 1998

[30] Foreign Application Priority Data

Nov. 4, 1997 [JP] Japan ..... 9-318982

[51] Int. Cl.[6] ..... B63C 11/02; B63C 11/46

[52] U.S. Cl. ..... 405/186; 405/185; 114/315

[58] Field of Search ..... 405/185, 186, 405/193; 441/86, 92, 96, 106, 108; 114/315, 322

[56] References Cited

U.S. PATENT DOCUMENTS

| | | | |
|---|---|---|---|
| 3,820,348 | 6/1974 | Fast | 405/186 |
| 4,009,583 | 3/1977 | Buckle | 405/186 |
| 4,608,940 | 9/1986 | Bullin | 405/186 |
| 4,926,398 | 5/1990 | Fincher | 405/186 X |
| 5,445,475 | 8/1995 | Fujino | 405/186 |
| 5,707,177 | 1/1998 | Lehrer et al. | 405/186 |
| 5,738,557 | 4/1998 | Biesecker | 441/92 |

FOREIGN PATENT DOCUMENTS

| | | |
|---|---|---|
| 52-141999 | 11/1977 | Japan . |
| 54-398 | 1/1979 | Japan . |
| 4-232191 | 8/1992 | Japan . |

*Primary Examiner*—David Bagnell
*Assistant Examiner*—Jong-Suk Lee
*Attorney, Agent, or Firm*—Trexler, Bushnell, Giangiorgi & Blackstone, Ltd.

[57] ABSTRACT

A neutral buoyancy auto-balancer eliminates the need for complex manipulation and operation in accordance with a change in diving depth. The auto-balancer automatically follows, rapidly and precisely, the change in diving depth by natural breathing during diving, and resolves the risk of failure of air-trapping not only in the vertical position but also in a slanted position to automatically follow a working posture of the diver. The neutral buoyancy auto-balancer comprises a weight 4 which radially outwardly extends from a shaft 14 which is rotatably supported at central holes 121, 131 of a cylinder 11 body. A nozzle 22 of an inlet duct 2 is fixed in the opposite direction to the projected weight 4. An inlet port 32 of an outlet duct 3 for both air evacuation and feed and drainage of water radially outwardly opens in the same direction as the weight 4. An angular displacement adjusting means 6 of the outlet port is provided for operably adjusting the direction of the outlet port with respect to the weight at any desired angle, and an initializer means 5 is provided for initializing a water level of the cylinder.

2 Claims, 8 Drawing Sheets

NEUTRAL BUOYANCY AUTO-BALANCER

BACKGROUND OF THE INVENTION

1. Field of the Invention

The present invention relates to a novel neutral buoyancy auto-balancer for a diver to carry when diving in the water to automatically provide neutral buoyant force at any given depth in the water any time, more specifically the present invention relates to a new and novel buoyancy equalizing device for a diver carrying said device to be able to stay at any given depth in the water any time, by automatically adjusting the amount of air which is compressible fluid and the source of buoyant force into such amount as corresponding to a neutral buoyant force between a positive buoyant force and a negative buoyant force, in response to the variation of the water pressure caused by the change of depth, when diving and surrounded by the water, as non-compressible fluid.

2. Description of the Prior Art

Among devices carried by a diver when diving, some associated with the buoyant force include: body itself of diver, wet suit, diving weight, BCD (flotation adjuster/jacket). The weight has always negative effect for the buoyant force, while the wet suit has always positive effect, and the body itself of the diver may vary between a negative and positive load. The buoyant force of human body varies in accordance of the difference of the state of expansion of the alveolus cavities, resulting from the respiration state of the diver. Breathe-out brings a negative flotation, and breathe-in brings a positive flotation. On the other hand the BCD varies the flotation by the change of volume thereof, with injection of air into its internal bag resulting in a positive flotation, and exhaust of air from the bag to the surrounding water resulting in a negative flotation.

FIG. 14 shows positional relation among diving devices in the prior art. In FIG. 14, compression air in a scuba tank 8 is supplied from a first decompression valve 81 though a second decompression valve, namely, a regulator 211, to a mouth-piece 214. The regulator 211 decompresses air to an equalized pressure—a pressure depending on the depth of the diver. Accordingly, the diver can smoothly breathe air into his lungs through the mouth-piece 214, regardless of the depth, and he can also naturally breathe air out of the lungs with the compression power of his lungs slightly overcoming the water-pressure due to his depth. Thus, by means of natural breath, air-bubbles can be breathed out by the diver through an exhaust port 213 into the surrounding water.

As shown in FIG. 14, in the Prior Art, a diver having a buoyancy control device (BCD) 9 carried on enters into the water. By operating manual valve 91 to supply air from an air cylinder 8 into the buoyancy control device 9 to inflate device, the diver may obtain buoyancy to be able to float on surface. Then, in order to dive, the diver operates the manual valve 91 to gradually lose buoyancy, as the air enclosed in the BCD 9 will be exhausted by the water pressure. At the time when the diver reaches to a desired depth, the diver operates the manual valve 91 again to stop exhaust of air to obtain buoyant force corresponding to that depth, so as to be able to stay at that depth.

In case of the device as stated above of the Prior Art, a diver is required to change the amount of air in the buoyancy control device 9 as the diver climbs or dives. Otherwise a diver may encounter a dangerous situation in that, when the diver dives in deeper depth, the buoyancy on that diver becomes excessively small to accelerate diving rate, and that when the diver climbs on contrary the buoyancy on the diver becomes excessively large to accelerate climbing rate. In order for a diver to pay attention on the operation of buoyancy control so often according to the change of depth without almost always any mistake, during diver's primary work in the water, the diver is required to have skill well trained and to have capability so as to calmly deal with the situation the diver meets in order not to be in panic.

Heretofore, in the description of buoyancy in the water, often a context is referred in which a diving bell, an object in a form of bell with an opening at the bottom and surrounding shields, is suspended in the water such that air in the bell is enclosed therewithin as the bottom opening is closed at the water surface.

Assuming that the weight of a diving bell suspended in the water is equalized to the buoyancy caused by the air enclosed therein. When gradually descending the diving bell down, hydraulic pressure which is one atmospheric pressure (atm) at the surface becomes gradually higher to compress the air in the bell. As a result, the water surface, the interface of the water with the air within the bell, will also gradually ascend, compressed air has smaller bulk volume and increases its density, and buoyancy decreases accordingly. If such a situation of negative buoyancy continues, the dropping rate of the diving bell will be accelerated further. If some amount of air corresponding to the water pressure at a given depth is added into the bell to descend the surface to the original level, the dive of the bell stops and the bell stays at that depth because buoyancy level moves from negative to neutral.

On the other hand, when ascending a bell which rests at a given depth with neutral buoyancy, surrounding water pressure gradually decreases and air in the bell inflates, so that the interface of the water with air in the bell descends down gradually and buoyancy increases accordingly. As a result the buoyancy becomes positive so that the bell ascends further. However, since certain excessive air in the bell will be exhausted to the outside through the bottom opening, the bulk volume of the air in the bell will be maintained at certain level, allowing for neutral buoyancy.

In the context as stated above, in order to obtain neutral buoyancy for such a bell, the opening is necessarily required to be held in the direction of gravity. If the opening is turned to the opposite direction of gravity, air in the bell is evacuated to the outside in one instant to eventually lose the functionality.

SUMMARY OF THE INVENTION

A primary object of the present invention is to provide a neutral buoyancy auto-balancer to eliminate the need for complex manipulation and operation in accordance with the change of diving depth, caused by using a BCD as mentioned above, to follow rapidly and precisely the slight change of diving depth, automatically by natural breathing when diving, in except for operation of initial adjustment.

A secondary object of the present invention is to provide a neutral buoyancy auto-balancer by improving the disadvantages as stated above of the diving bell to resolve the risk of failure of air-trapping not only in the vertical position but also in slanted position to automatically follow working posture of diver.

In order to achieve said primary and secondary objects, a neutral buoyancy auto-balancer according to the present invention comprises:

- a cylinder having a cylindrical body and two end-plates on both sides thereof;
- a shaft rotatably mounted to each of central holes of said two hemispherical end-plates on both sides by means of a bearing with a waterproof means;

a weight having its base integrated to said shaft, mounted on said shaft in a form projected radially outwardly from said base to the perimeter of said cylinder within said cylinder;

an inlet duct having its base integrated to said shaft, and a nozzle projected in opposite direction to the projection of said weight in said cylinder, said nozzle communicating with a tip of exhaust tube from a regulator located separately outside of said cylinder at said central hole in one side;

an outlet duct having its base integrated to said shaft, and an outlet port opened in the same radially outward direction to the projection of said weight in said cylinder to serve as water inlet/outlet and gas outlet, said outlet duct communicating with an exhaust opening outside the cylinder at said central hole in another side;

an angular displacement adjusting means of said outlet port for operably adjusting the direction of said outlet port with respect to said weight at any desired angle from outside; and an initializer means for initializing water level of said cylinder;

wherein it: is considered that when said cylinder is used such that the axis across said central holes of each of said hemispherical end-plate is positioned horizontally, irrelevant to the displacement in the circumferential direction of said cylinder body, among fluids flowable to and from said cylinder through said central holes, water is always positioned in the gravity direction and air is positioned in the anti-gravity direction;

wherein when increased water pressure associated with the increased diving depth causes water to enter into said cylinder through said central hole in said another side to compress air enclosed in said cylinder to increase water level and to decrease buoyancy, exhaust air from said regulator is introduced through said central hole in the one side into said cylinder to supply an amount of air enough to fulfill to said initialized level, while some excessive amount of air supplied beyond said initialized level is automatically flew from said outlet port through said central hole in another side to the outside of said cylinder, such that a predetermined volume of air is reserved within said cylinder to maintain neutral buoyancy;

wherein on the other hand when decreased water pressure associated with the decreased diving depth causes air in said cylinder to inflate to drain some water from within the cylinder through said central hole in the another side to the outside to decrease the water level and to increase buoyancy, inflated excessive amount of air beyond the initialized level is automatically flew from said outlet port through said central hole in another side to the outside of said cylinder, such that a predetermined volume of air is reserved within said cylinder to maintain neutral buoyancy.

A neutral buoyancy auto-balancer in accordance with the present invention may comprise, instead of an angular displacement adjusting means of said outlet port for operably adjusting said outlet port with respect to said weight at any desired angle;

a radial adjustment means of said outlet port for operably adjusting said outlet port along with its radial direction from outside.

The above and other benefit, features, and advantages of the present invention will become more fully apparent from consideration of the following detailed description to those skilled in the art.

BRIEF DESCRIPTION OF THE DRAWINGS

The following description of a preferred embodiment of the present invention may be best understood by reading carefully with reference to the accompanying drawings, in which.

DETAILED DESCRIPTION OF THE PREFERRED EMBODIMENTS

[First Embodiment]

Figure 1:
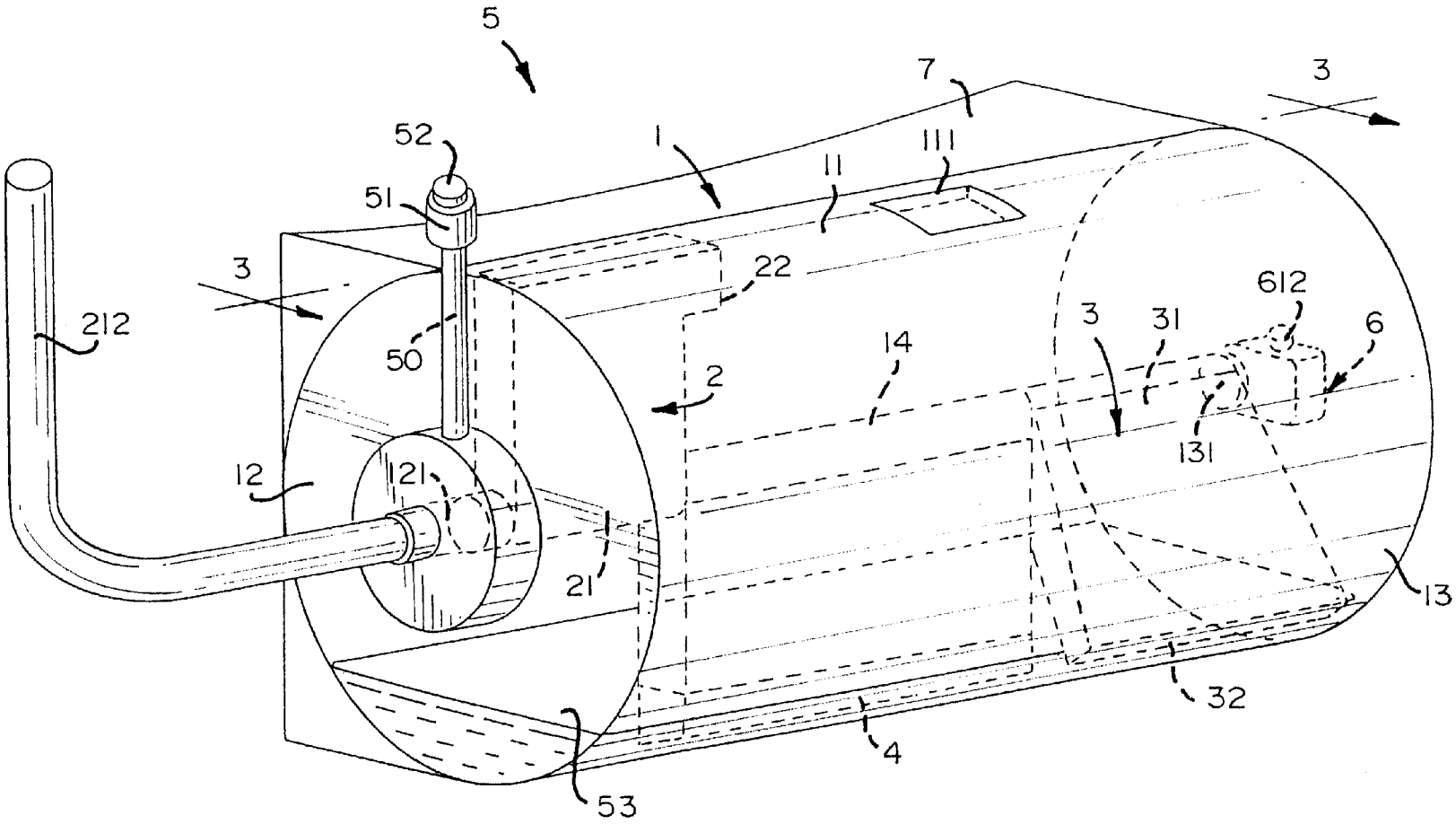
FIG. 1 shows a schematic perspective view illustrating the principle of the neutral buoyancy auto-balancer in accordance with the present invention as a preferred embodiment incorporated into a device for scuba diving.
Figure 2:
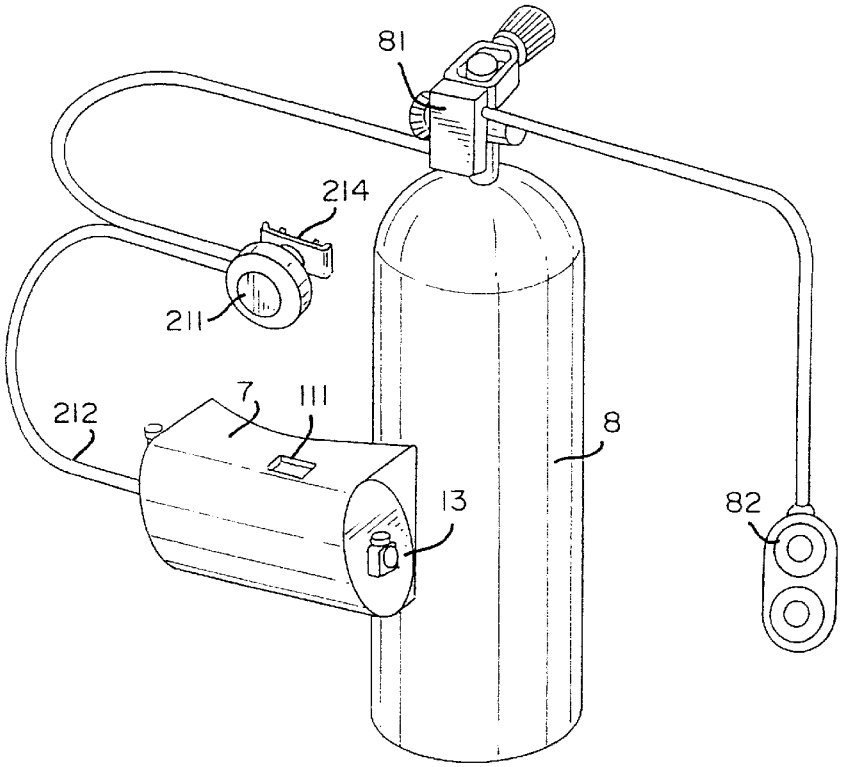
FIG. 2 shows a schematic diagram illustrating the relationships of the neutral buoyancy auto-balancer for scuba diving shown in FIG. 1 with an air cylinder and a regulator.

The overview of a preferred embodiment incorporating a neutral buoyancy auto-balancer in accordance with the present invention for scuba diving is shown in FIG. 1. The positional relationships between the neutral buoyancy auto-balancer in accordance with the present invention with an air cylinder 8 for dive and a regulator (second decompression valve) 211 is shown in FIG. 2.

Now reference is made to FIG. 1, a cylinder 1 comprises a cylindrical body 11 and hemispherical circular end-plates 12 and 13 at the both sides of the cylinder. Each of central holes 121 and 131 of the end-plates 12 and 13 at both side of the cylinder 1 may rotatably support a shaft 14 with intervention of bearings 122 and 132 (see FIG. 3) incorporating waterproof means 123 and 133.

Figure 6:
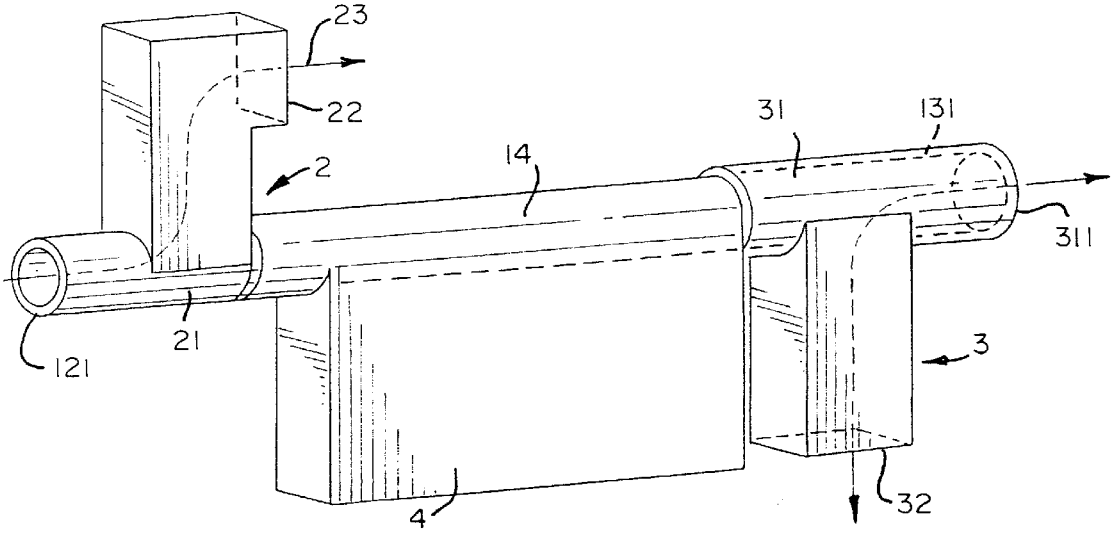
FIG. 6 shows a perspective view exemplifying an assembly of the shaft, inlet/outlet ducts and weight assembled as shown in FIG. 5.
Figure 5:
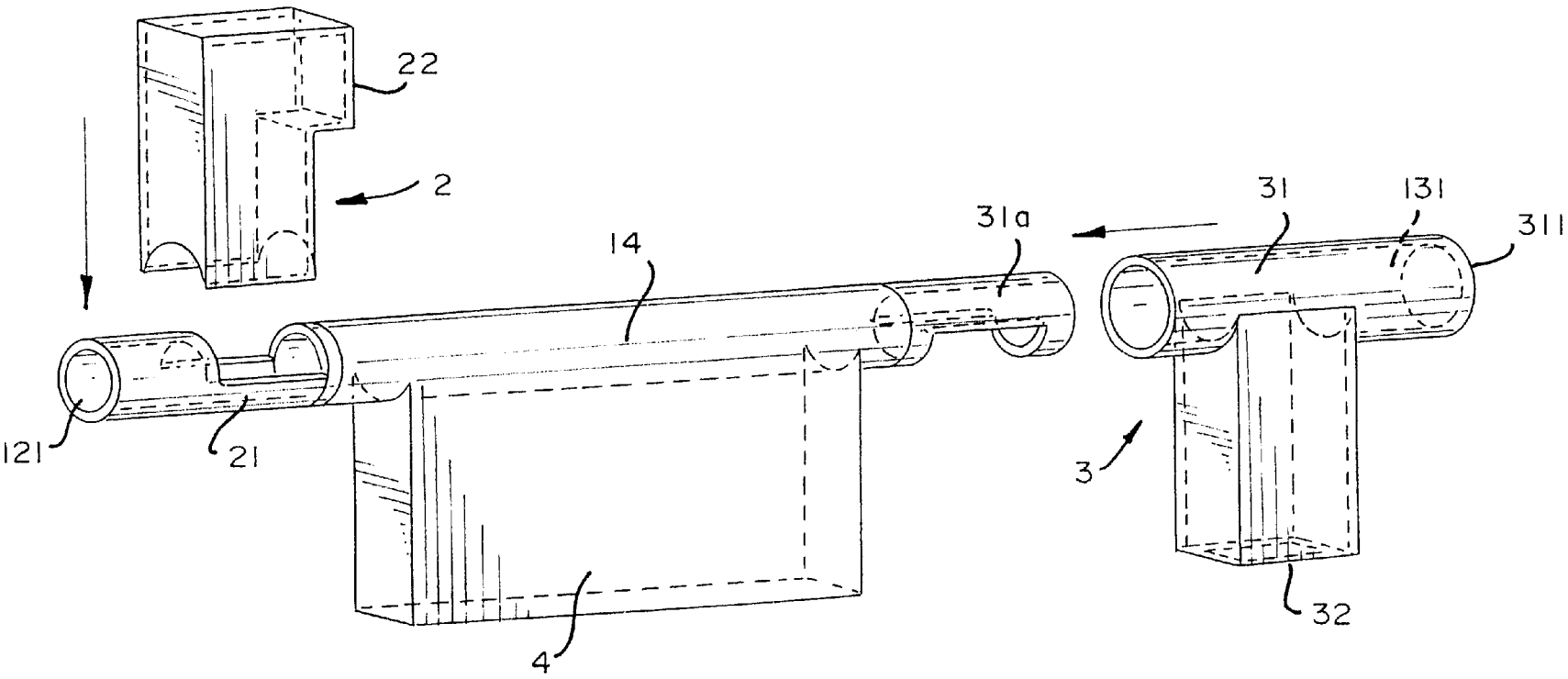
FIG. 5 shows an exploded perspective view exemplifying a shaft rotatably mounted across central holes at hemispherical end-plates in both sides of the cylinder, associated with the attachment of inlet duct, outlet duct, and weight onto the shaft.

The shaft 14 has, as can be most explicitly seen from FIG. 5 and 6, at its central portion, a weight 4 mounted thereon which extends radially outwardly in the cylinder 1 from the base on the shaft 14, in one side of the base of which fixed is a tubing 21 forming the base of an inlet duct 2, in other side of the base of which fixed is an inner tubing 31*a* forming the base of an outlet duct 3 for both air evacuation and the feed and drainage of water, which the inner tubing 31*a* is in turn slidably rotatably fitted to an outer tubing 31. The shaft 14 mounted between respective central holes 121 and 131 on the end-plates 12 and 13 at both sides of the cylinder 1 is formed so as to arrange the tubing 21 of the inlet duct 2, the base of the weight 4, and the inner tubing 31a and outer tubing 31 of the outlet duct 3, in its longitudinal axis.

The inlet duct 2 is fitted at its base to a notch of said tubing 21. In the opposite direction of approximately 180 degrees of the projection of the weight 4, a nozzle 22 is formed protruded therefrom in the cylinder 1. In addition, the inlet duct 2 is communicating with the tip of an exhaust tube 212 from the regulator 211 (see FIG. 2) outside the cylinder at the central hole 121. This allows to exhaust air from the regulator 211 to pass through the tubing 212, central hole 121, and tubing 21, and to eventually be introduced into the cylinder 1 via the nozzle 22 of the inlet duct 2 as shown by an arrow line 23 in FIG. 6.

The outlet: duct 3 for both air evacuation and feed and drainage of water is, as shown in FIG. 5 and 6, rotatably circumferentially slidably fitted at its base in the range of alignment of respective notches of the inner tubing 31*a* and the outer tubing 31. An inlet port 32 of the outlet duct 3 is opened in a direction radially outwardly aligned with the projection of the weight 4 in the cylinder 1. In this way, the outlet duct 3 may drain water and/or air in the cylinder 1 from the inlet port 32 through the inner tubing 31*a*, the outer tubing 31, and a central hole, namely an exhaust opening 131, to the outside in case in which the internal pressure of the cylinder 1 become elevated with respect to the water pressure of surrounding environment, while on the other hand the outlet duct 3 may introduce into the cylinder 1 some free water passing from outside through the central hole 131, the outer tubing 31, and the inner tubing 31*a* to the inlet port 32, in case in which the internal pressure of the cylinder 1 become reduced with respect to the water pressure of surrounding environment.

Figure 3:
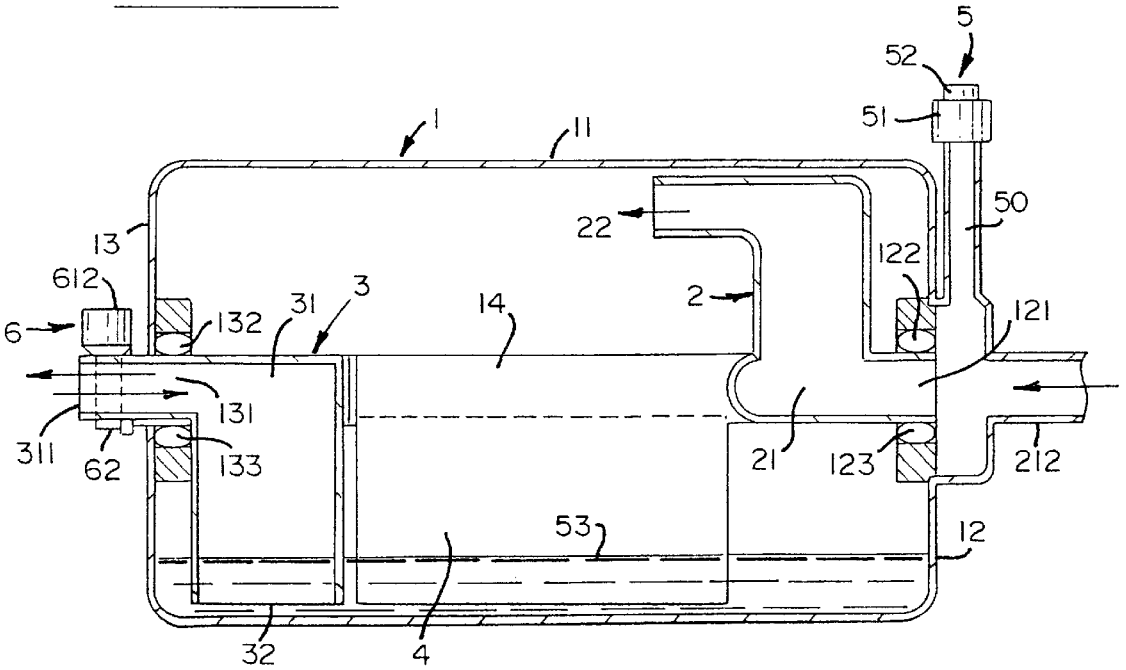
FIG. 3 shows a schematic elevational view in section taken along with line 3—3 in FIG. 1, before initializing the neutral buoyancy setting.
Figure 4:
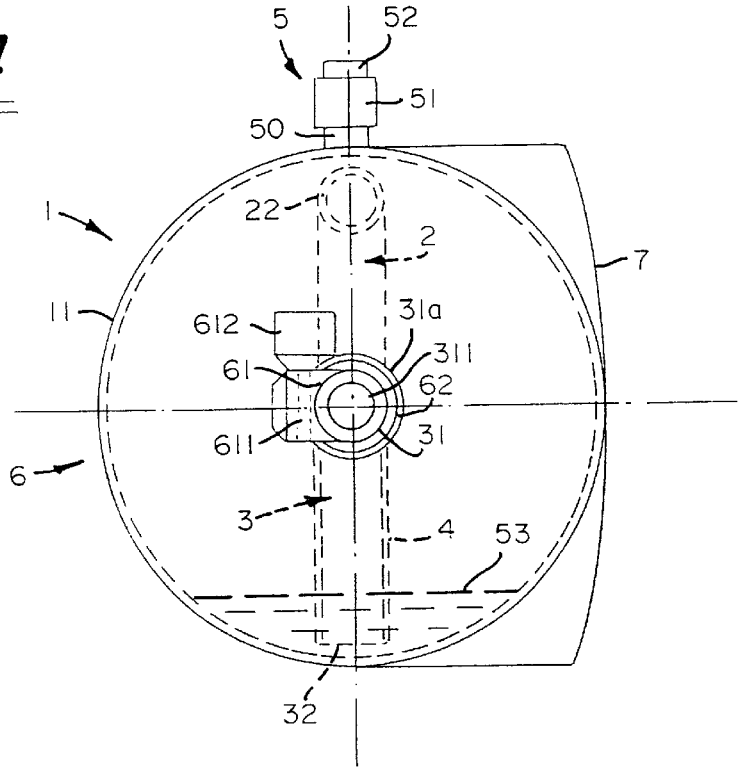
FIG. 4 shows a left side view of FIG. 3.

An angular displacement adjusting means of the inlet port 32 with respect to the weight 4 is arranged to secure, as clearly shown in FIG. 3 and 4, a gear box 611 axially supporting a worm (spiral) gear 61 at the outer surface of the end-plate 13 at another side, with a knob 612 being provided at the end of the shaft 14 extended from the gear box. The angular displacement adjusting means also secures a worm wheel 62 at the outer periphery of the outer tubing 31 so as to engage the worm wheel 62 with the worm 61. In this way, when a diver rotates with his/her finger the knob 612, the worm 61 spins and the worm wheel 62 engaged thereto rotates accordingly to displace the outlet duct 3 integrated therewith at the center of the inner tubing 31*a*. The inlet port 32 located at the remote end of the outlet duct 3 moves spaced apart to a desired degree from the radial axis of the weight 4 (see FIG. 7 through 11). As a result, the inlet port 32 may be positioned at a level elevated by any desired height from the vertical level designated by the weight 4. Operation of the device will be described below in greater detail.

An initializer means 5 for initializing water level in the cylinder 1 in accordance with the variation of buoyancy including the body weight of scuba diver comprises, as shown in FIG. 1 and 3, an air bleeder tubing 50 extendingly mounted from the central hole 121 on the outer surface of the endplate 12 at the one end, at the tip of which is provided a bleeder valve 51, and a button 52 for opening and closing the bleeder. If the button 52 is pressed by a scuba diver at the surface level of water pressure 1 atm., the bleeder valve 51 is opened to purge air in the cylinder 1 through a valve 51 and a tubing 50 to the environment. At the same time some water is introduced from an outlet port 311 through inlet port 32 into the cylinder 1, so as to set water level 53 corresponding to the water pressure 1 atm. for that scuba diver in the cylinder 1 when the diver's whole body completely sinks under water.

In FIG. 1 and 2, reference numeral 7 designates to an attachment for attaching the neutral buoyancy auto-balancer to the chest of diver, numeral 8 to the air cylinder, 81 to a first pressure reducing valve, 82 to a fathometer and a pressure gauge, 211 to the regulator (second pressure reducing valve), 212 to the exhaust tubing connecting the regulator to the central hole 121 of the neutral buoyancy auto-balancer.

With the neutral buoyancy auto-balancer of such arrangement as described above, the functionality of its components when a diver initializes level-in-cylinder, sinks from the surface, and raises from deep level under water will be described below in greater detail in this order.

For preparation of diving, as shown in FIG. 2, a diver first attaches firmly the neutral buoyancy auto-balancer on the chest or abdomen by using the attachment 7, carries on his/her back an air cylinder 8, connects the tip of tubing 212 of the regulator 211 to the central hole 121 of the end-plate 12 in one side of the neutral buoyancy auto-balancer, and zeroes the angle of the inlet port 32 in the cylinder 1 with respect to the weight 4. Then the diver enters into the water. As the cylinder 1 is fulfilled by air, it provides sufficient buoyancy for the diver to permit to float on the surface of the water.

Next, in order to initialize the water level 53 in the cylinder 1 before sinking, pressing the button 52 causes air in the cylinder 1 to bleed through the valve 51 and tubing 50 into the environment, while at the same time it causes some water to be introduced from the outlet port 311 through the inlet port 32. When the whole body of a scuba diver is completely sunk under water, water and air will be balanced at the water level 53 at the water pressure 1 atm. corresponding to the buoyancy of that diver. The level 53 is at this point attained to a level higher than the position of the inlet port 32 of the outlet duct 3, as shown in FIG. 3 and 4.

At this point the diver releases the button 52 to close the bleeder valve 51 so as to prevent leakage of air in the cylinder 1 and operates the knob 612 to spin the worm 61 to rotate the worm wheel 62 engaging therewith so as to gradually increase the relative angle between the integrated outlet duct 3 and the weight 4. Since the weight 4 stays in vertical position due to its weight, the inlet port 32 of the outlet duct 3 displaces in the lateral direction, eventually to the location at which the port reaches to the water level 53. If the knob 612 is released at the time that the diver confirms the outlet duct 3 have reached to that position, for example by observing through a viewing glass 111, as shown in FIG. 1 and 2, the outlet duct 3 will stay at that angular position due to worm engagement. In such a way the angular adjustment of the inlet port 32 corresponding to the initial level in the cylinder 1 is completed. Thereafter, air introduced into the cylinder 1 through tubing 212 of the regulator 211 will be bled, passing through the inlet port 32 and then the outlet port 311 of the outlet duct 3 to the outside in the water as excessive supply, so that the balance of air and water in the cylinder 1 will remain unchanged, and maintain the adjusted neutral buoyancy.

Now, diving is ready to go. There are two ways of diving for the neutral buoyancy auto-balancer according to the present invention: First, air-bleed diving method which is performed by continuously pushing the button 52 of the bleeder valve 51 to purge air from the cylinder 1 and introduce water from the outlet port 311 into the cylinder 1 to decrease buoyancy of the cylinder. Second, fin diving method which is performed by using fins to go down in position upside-down.

Figure 14:
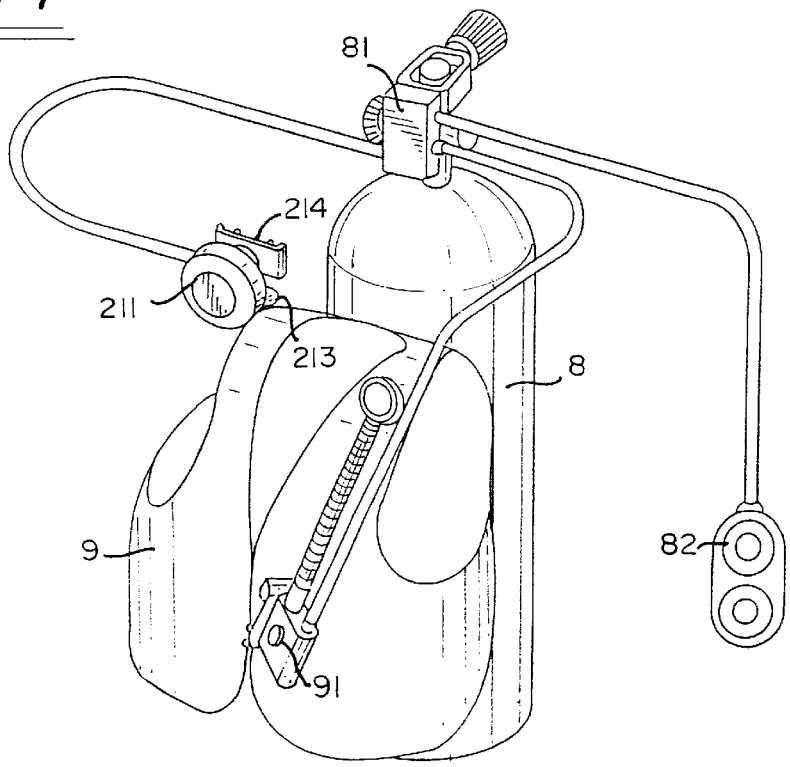
FIG. 14 PRIOR ART

In the air-bleed diving method, exhaust gas made by the respiration of diver and supplied from the regulator to the cylinder may temporarily increase buoyancy of the device. However, excessive amount of air beyond the range of neutral buoyancy may not reside in the cylinder; excessive air will be purged through the outlet duct 3 to the outside. Even though the diving rate may be slightly slowed down, this method assures not to upwardly climb. When the button 52 of the bleeder valve 51 is released for staying at a given desired depth, it is conceivable that the amount of air residing in the cylinder 1 may become temporarily insufficient for an instant to cause a negative buoyancy (see FIG. 7). However continuous introduction of air from the regulator will quickly create buoyancy sufficient to stabilize (see FIG. 8) Excess water which invaded the cylinder 1 is pressed out of the cylinder 1 through the outlet port 32 by means of natural breath as described in the above discussion relating to FIG.14.

Figure 7:
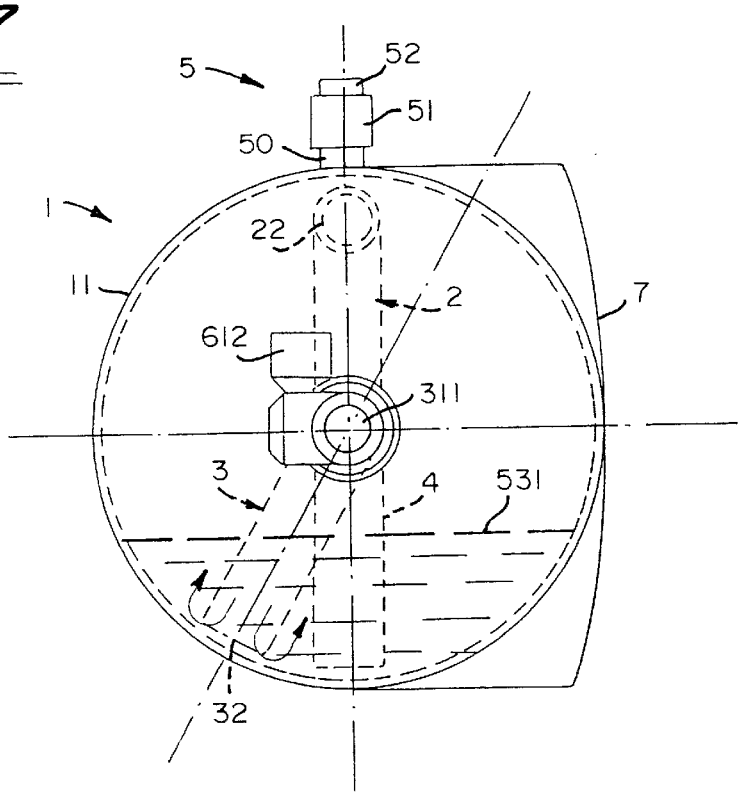
FIG. 7 shows a left side view of FIG. 3 illustrating a temporary augmentation of water level in cylinder during diving after the completion of initialization of neutral buoyancy setting.
Figure 8:
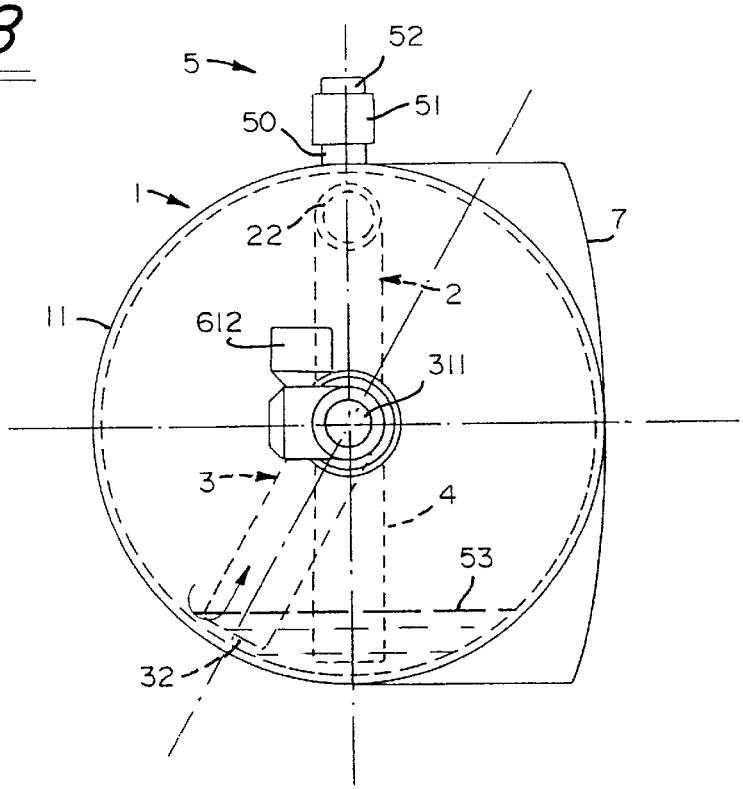
FIG. 8 shows a left side view of FIG. 3 illustrating a recovery of neutral buoyancy by introducing exhaust air from the regulator to automatically drain excessive water in case of FIG. 7.
Figure 9:
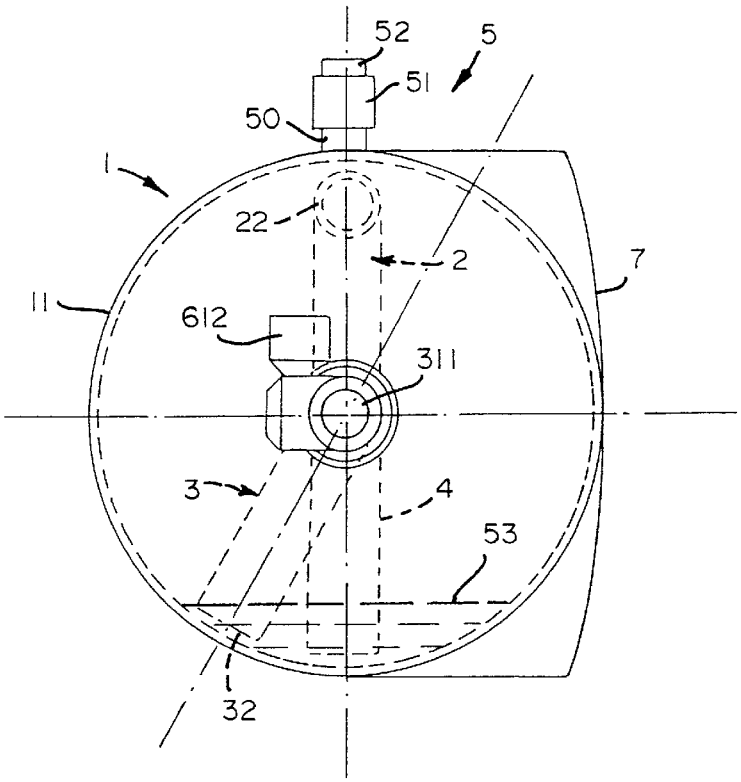
FIG. 9 shows a left side view of FIG. 3 illustrating the operation of the neutral buoyancy auto-balancer in the vertical position in which the posture of diver is along with the gravity direction.

In fin diving method, increasing depth may introduce, as shown in FIG. 7, some negative buoyancy for a short time of period to cause increase of water level 531 and acceleration of diving rate. However continuous introduction of air from the regulator will quickly recover the water level into the water level 53 to obtain neutral buoyancy, as shown in FIG. 8.

The most significant characteristics of the fin diving method is that a diver is in position upside-down, i.e., legs are up and head is down. In this situation the neutral buoyancy auto-balancer attached to the chest and/or abdomen of diver also is forced to be in anteversion or retroversion, as shown in FIG. 10 and 11, about the axis 14.

Figure 10:
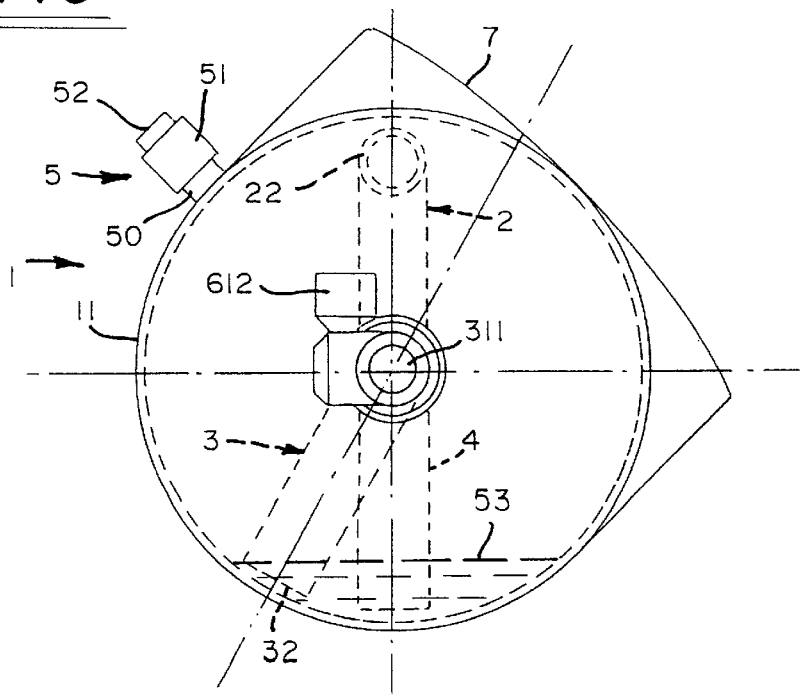
FIG. 10 shows a left side view of FIG. 3 illustrating the operation of the neutral buoyancy auto-balancer in the slanted position in which the posture of diver is inclination at the angle of forty-five degrees with respect to the gravity direction.
Figure 11:
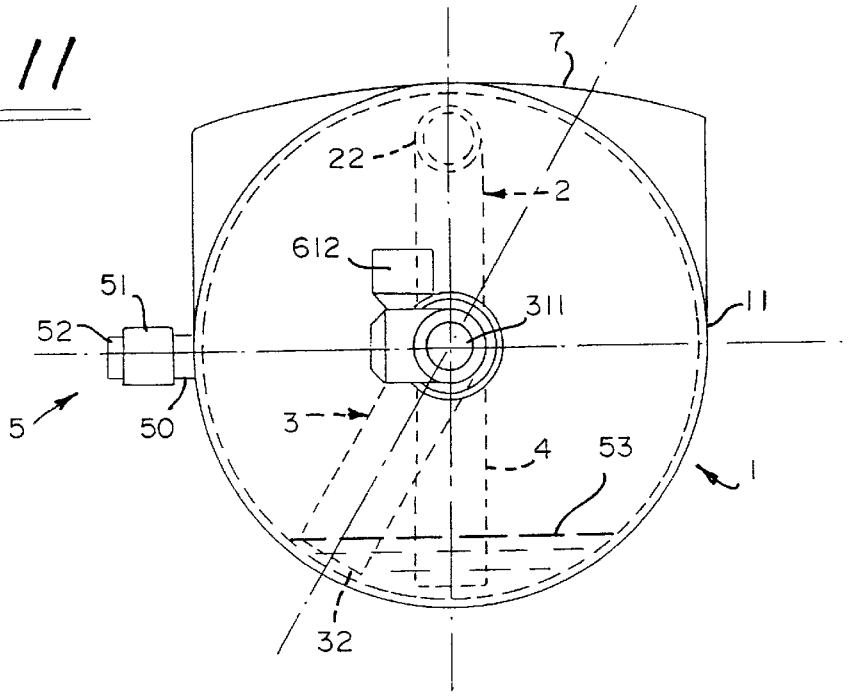
FIG. 11 shows a left side view of FIG. 3 illustrating the operation of the neutral buoyancy auto balancer in the horizontal position in which the posture of diver is inclination at the angle of ninety degrees with respect to the gravity direction.

For the neutral buoyancy auto-balancer in accordance with the present invention, when the attachment 7 is inclined in front or back at. for example, forty-five degrees as shown in FIG. 10, ninety degrees as shown in FIG. 11, and hundred-thirty-five degrees or hundred eighty degrees (not shown) about the shaft 14 on the center line of the cylindrical body 11, the weight 4 in the cylindrical body 11 remains in vertical position so that the inlet port 32 of the outlet duct 3 keeps a predetermined angular position with respect to the vertical weight 4. Accordingly the interface of water and air, the water level 53 in the cylinder 1, moves and stays in the same vertical direction as the weight 4 because water is always heavier than air. The inlet port 32 at a desired angular position is in turn brought to a location of the interface of water and air, so as to be always able to reside in a desired water level 53, to purge water up to the level if amount of water is excessive, and to purge air up to the level if amount of air is excessive, in order to perform the functionality of holding the water level to a predefined level, i.e., holding neutral buoyancy.

When upwardly moving under water, water pressure in the cylinder decreases, leading to inflation of air in the cylinder accordingly, thus temporary positive buoyancy. However the neutral buoyancy auto-balancer quickly recovers neutral buoyancy because excessive air will be immediately purged from the inlet port 32 to the outside.

When reached to the surface, by operating an angular position adjusting knob 612 to readjust the angular displacement of the outlet duct 3 to align with the weight 4 to position the inlet port 32 at the lowest height in the cylinder, most water in the cylinder 1 will be purged, the cylinder 1 will be fulfilled with air so that the buoyancy of neutral buoyancy auto-balancer will become maximum to help a diver floating on the surface.

[Second Embodiment]

Figure 12:
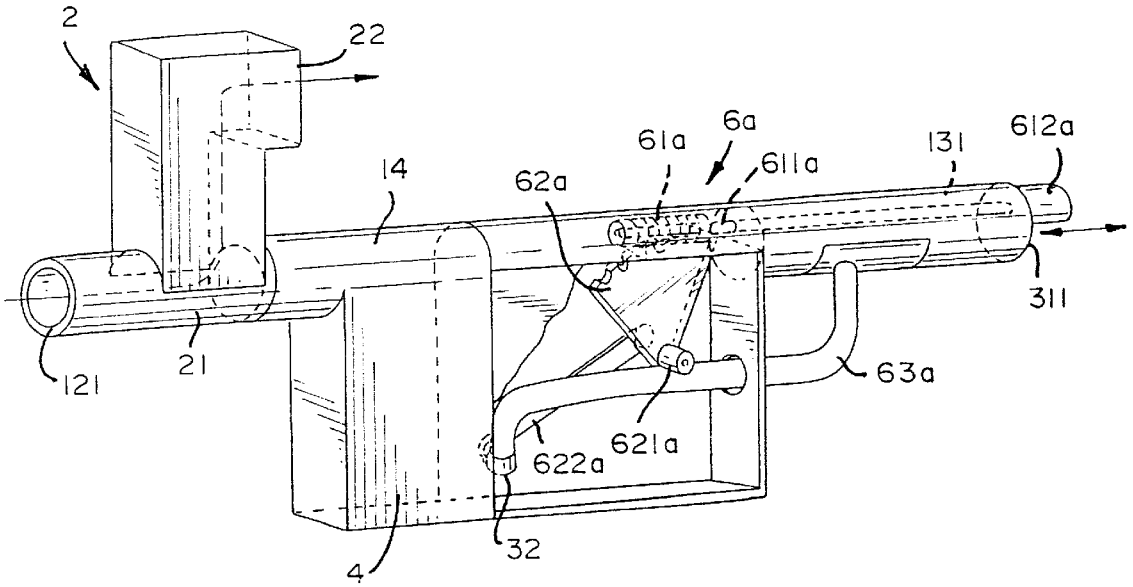
FIG. 12 shows a schematic perspective view partly in section illustrating as another preferred embodiment of angular displacement adjusting means of the inlet port in accordance with the present invention, some components associated with radially inwardly positioned inlet port.
Figure 13:
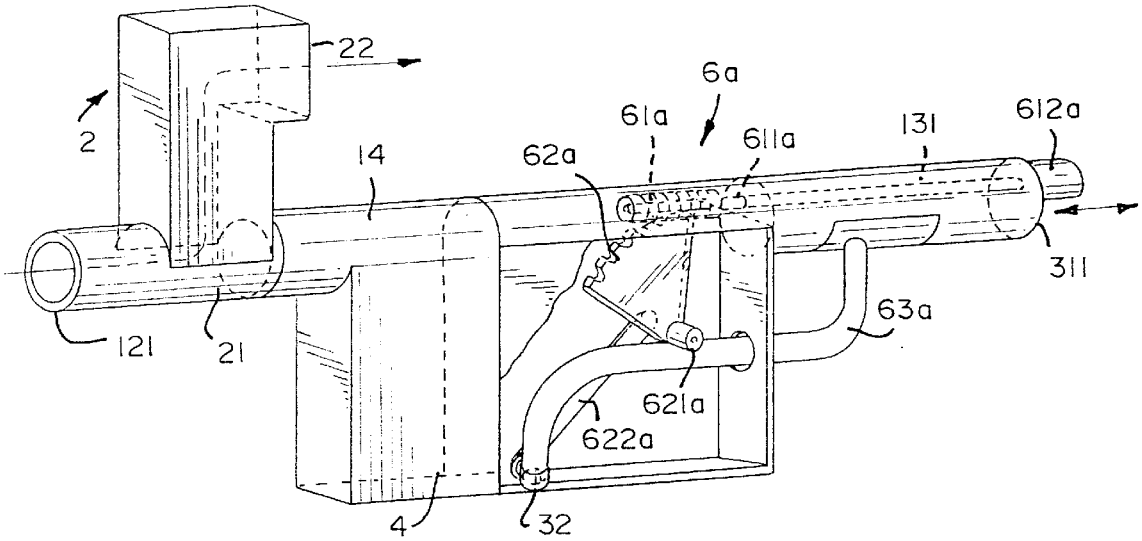
FIG. 13 shows a schematic perspective view partly in section illustrating as of in FIG. 12, some components associated with radially most-outwardly positioned outlet port; and, FIG. 14 shows a schematic perspective view illustrating the positional relationships among diving devices with a buoyancy control device (BCD) in the Prior Art.

Now reference is made to FIG. 12 and 13, there is shown an alternative embodiment of the present invention, comprising, instead of an angular displacement adjusting means 6 of the outlet port 32 for operably adjusting the outlet port 32 with respect to the weight 4 at any desired angle as mentioned above, a radial adjustment means 6a of the outlet port 32 for adjusting the outlet port 32 along with its radial direction from outside. FIG. 12 illustrates the inlet port 32 displaced inwardly along its radial direction; FIG. 13 illustrates the inlet port 32 displaced outwardly along its radial direction. In this embodiment the outlet duct 3 is replaced with a flexible tube 63*a*, inlet port 32 provided at the tip of the tube is made adjustable from outside by means of a combination of worm and arm mechanisms.

More specifically, the inlet port 32 positioned at the tip of a flexible tube 63*a* is supported by a free end of an arm 622*a*. The base of the arm 622*a* is secured to a shaft 621*a* and a worm wheel 62*a* centered about the shaft 621*a* in a form of sector-of-a-circle is provided. A worm 61*a* engaging to the worm wheel 62*a* is mounted in a hollow tube which is concentrically arranged to the shaft 14. The shaft 611*a* of the worm 61*a* is arranged so as to be projected from the outlet port 311 to the outside through the central hole 131 to provide a knob 612*a* at the projected end of the shaft 611*a*. In this way, a diver may rotate the knob 612*a* from the outside of the neutral buoyancy auto balancer to transfer rotational movement through the shaft 621*a* to the worm 61*a*, and then the worm wheel 62*a* engaging to the worm 61*a* is rotated around the shaft 621*a* to create angular displacement of the arm 622*a* extending from the shaft 621*a*. The free end of the arm 622*a* then displaces in its radial direction so that the inlet port 32 connected to the free end of the arm accordingly displaces along its radial direction.

As have been described above, the neutral buoyancy auto-balancer according to the present invention require no adjustment during diving, except for the manual initialization of the water level in its cylinder at the water surface in an area of water pressure 1 atm. Thereafter, during sinking, staying at any given depth, and climbing, the neutral buoyancy auto-balancer automatically operates, only by means of introduction of air used by the respiration of a diver into the cylinder, to maintain neutral buoyancy. Many trouble caused by the misoperation of divers may be avoided and divers may work under water without risk and perplex adjustment.

In addition, the neutral buoyancy auto-balancer according to the present invention is formed as a cylinder about an axis, while inside, a weight extended from the axis directs in vertical direction regardless of circumferential displacement of the cylinder. By arranging air inlet port to be rotatable in inward and outward direction along its radial direction, when the cylinder is rotated or inclined in its circumferential direction, about its center axis, outlet port can be moved to accurately locate at or near the variable water level in the cylinder. Using the neutral buoyancy auto-balancer according to the present invention provides divers with a significantly large degree of freedom with respect to their diving position, allowing for neutral buoyancy auto-balance under water in addition to the wide range of postures.

Although the present invention has been described in conjunction with several preferred embodiments thereof, it should be understood that these embodiments are disclosed by way of examples and the present invention is not to be limited thereto. It should be recognized that many changes and modifications may be made by those skilled in the art without departing from the true spirit and the scope of the present invention set forth in the appended claims.

What is claimed is:

1. A neutral buoyancy auto-balancer, comprising:

a cylinder having a cylindrical body having a first end and a second end, said cylinder having a first end-plate on said first end and having a second end-plate on said second end, each of said first and second end-plates having a central hole;

a shaft rotatably mounted to the central hole of each of said first and second end-plates by means of a waterproof means;

a weight mounted on said shaft such that the weight projects radially outwardly from said shaft within said cylinder toward a perimeter of said cylinder;

an inlet duct integrated to said shaft, and having a nozzle which projects in a direction which is generally opposite to the projection of said weight in said cylinder, said nozzle communicating with a tip of an exhaust tube from a regulator located separately outside of said cylinder at said central hole of said first end-plate;

an outlet duct having a base integrated to said shaft, and having an outlet port in said cylinder to serve as a water inlet/outlet and a gas outlet, said outlet duct communicating with an exhaust opening outside the cylinder at said central hole of said second end-plate;

an angular displacement adjusting means associated with said outlet port for operably adjusting the direction of said outlet port with respect to said weight at any desired angle from a vertical axis of the weight; and an initializer means for initializing a water level of said cylinder;

wherein when said cylinder is used such that the axis across said central holes of the first and second end-plates is positioned generally horizontally, irrelevant to the displacement in the circumferential direction of said cylinder body, among fluids flowable to and from said cylinder through said central holes, water is always positioned in the gravity direction and air is positioned in the anti-gravity direction;

wherein when increased water pressure associated with an increased diving depth causes water to enter into said cylinder through said central hole in said second end-plate to compress air enclosed in said cylinder to increase water level and to decrease buoyancy, exhaust air from said regulator is introduced through said central hole in the first end-plate into said cylinder to supply an amount of air enough to fulfill to said initialized level, while some excessive amount of air supplied beyond said initialized level automatically escapes from said cylinder through said outlet port and through said central hole in the second end-plate to the outside of said cylinder, such that a predetermined volume of air is reserved within said cylinder to maintain neutral buoyancy;

wherein on the other hand when decreased water pressure associated with a decreased diving depth causes air in said cylinder to inflate to drain some water from within the cylinder through said central hole in the second end-plate to the outside to decrease the water level and to increase buoyancy, inflated excessive amount of air beyond the initialized level automatically escapes from said cylinder through said outlet port and through said central hole in the second end-plate to the outside of said cylinder, such that a predetermined volume of air is reserved within said cylinder to maintain neutral buoyancy.

2. A neutral buoyancy auto-balancer, comprising:

a cylinder having a cylindrical body having a first end and a second end, said cylinder having a first end-plate on said first end and having a second end-plate on said second end, each of said first and second end-plates having a central hole;

a shaft rotatably mounted to the central hole of each of said first and second end-plates by means of a waterproof means;

a weight mounted on said shaft such that the weight projects radially outwardly from said shaft within said cylinder toward a perimeter of said cylinder;

an inlet duct integrated to said shaft, and having a nozzle which projects in a direction which is generally opposite to the projection of said weight in said cylinder, said nozzle communicating with a tip of an exhaust tube from a regulator located separately outside of said cylinder at said central hole of said first end-plate;

an outlet duct having a base integrated to said shaft, and having an outlet port in said cylinder to serve as a water inlet/outlet and a gas outlet, said outlet duct communicating with an exhaust opening outside the cylinder at said central hole of said second end-plate;

a radial adjustment means generally outside said cylinder and associated with said outlet port and configured with respect to said outlet port for operably changing an orientation of said outlet port with respect to said weight; and an initializer means for initializing a water level of said cylinder;

wherein when said cylinder is used such that the axis across said central holes of the first and second end-plates is positioned generally horizontally, irrelevant to the displacement in the circumferential direction of said cylinder body, among fluids flowable to and from said cylinder through said central holes, water is always positioned in the gravity direction and air is positioned in the anti-gravity direction;

wherein when increased water pressure associated with an increased diving depth causes water to enter into said cylinder through said central hole in said second end-plate to compress air enclosed in said cylinder to increase water level and to decrease buoyancy, exhaust air from said regulator is introduced through said central hole in the first end-plate into said cylinder to supply an amount of air enough to fulfill to said initialized level, while some excessive amount of air supplied beyond said initialized level automatically escapes from said cylinder through said outlet port and through said central hole in the second end-plate to the outside of said cylinder, such that a predetermined volume of air is reserved within said cylinder to maintain neutral buoyancy;

wherein on the other hand when decreased water pressure associated with a decreased diving depth causes air in said cylinder to inflate to drain some water from within the cylinder through said central hole in the second end-plate to the outside to decrease the water level and to increase buoyancy, inflated excessive amount of air beyond the initialized level automatically escapes from said cylinder through said outlet port and through said central hole in the second end-plate to the outside of said cylinder, such that a predetermined volume of air is reserved within said cylinder to maintain neutral buoyancy.

* * * * *